US010532479B2

(12) United States Patent
Slater

(10) Patent No.: US 10,532,479 B2
(45) Date of Patent: Jan. 14, 2020

(54) CUTTING APPARATUS

(71) Applicant: Jonathan Slater, Hampshire (GB)

(72) Inventor: Jonathan Slater, Hampshire (GB)

( * ) Notice: Subject to any disclaimer, the term of this patent is extended or adjusted under 35 U.S.C. 154(b) by 107 days.

(21) Appl. No.: 15/753,629

(22) PCT Filed: Aug. 22, 2016

(86) PCT No.: PCT/GB2016/052596
§ 371 (c)(1),
(2) Date: Feb. 20, 2018

(87) PCT Pub. No.: WO2017/029527
PCT Pub. Date: Feb. 23, 2017

(65) Prior Publication Data

US 2018/0250842 A1 Sep. 6, 2018

(30) Foreign Application Priority Data

Aug. 20, 2015 (GB) ..... 1514853.9

(51) Int. Cl.
*B26B 29/06* (2006.01)
*B26B 29/02* (2006.01)

(52) U.S. Cl.
CPC ..... *B26B 29/063* (2013.01); *B26B 29/02* (2013.01); *B26B 2029/066* (2013.01)

(58) Field of Classification Search
CPC .. B26B 29/063; B26B 2029/066; B26B 29/02
See application file for complete search history.

(56) References Cited

U.S. PATENT DOCUMENTS 1,574,641 A * 2/1926 Christopherson ..... B44C 7/025 30/293
1,614,772 A 1/1927 Bambini et al.
2,453,220 A * 11/1948 Gustafson ..... B26B 3/03 30/283

(Continued)

FOREIGN PATENT DOCUMENTS

AT 124068 B 8/1937
CN 203141513 U 8/2013

(Continued)

OTHER PUBLICATIONS

International Patent Application No. PCT/GB16/052596, International Search Report dated Oct. 25, 2016.

(Continued)

*Primary Examiner* — Hwei-Siu C Payer
(74) *Attorney, Agent, or Firm* — Leber IP Law; Celia H Leber

(57) ABSTRACT

A cutting apparatus for cutting an item supported by a surface, comprising a knife (1) comprising a blade (2), a blade support means (3), and an alignment guide (4), having an arm (7) pivotally attached to the knife and a surface contacting means (8) extending in a direction substantially perpendicular to the longitudinal plane of the knife and adapted to contact the surface in front of the blade, in the cutting direction so that, in use, the alignment guide can move with the blade, as the blade cuts into an item whereby if the knife tilts or tends to tilt, this is resisted by virtue of the alignment guide or, if the resistance is overcome, is reduced by raising of one or other lateral edges of the surface contacting means.

15 Claims, 5 Drawing Sheets

(56) References Cited

U.S. PATENT DOCUMENTS

| | | | | |
|---|---|---|---|---|
| 2,777,197 | A | 1/1957 | Rothman | |
| 2,901,824 | A * | 9/1959 | Zullo | B26B 29/02 30/295 |
| 3,092,903 | A * | 6/1963 | Bockhold | B26B 5/006 30/2 |
| 4,589,206 | A * | 5/1986 | Marcoux | A21C 15/04 30/114 |
| 5,802,723 | A * | 9/1998 | Haggar | B26B 3/03 30/283 |
| 6,694,649 | B2 | 2/2004 | Whited et al. | |
| 6,748,659 | B1 | 6/2004 | Street | |
| 2008/0127497 | A1 * | 6/2008 | Moss | B26B 5/007 30/304 |
| 2010/0263218 | A1 * | 10/2010 | Bookhamer | B26B 3/02 30/298.4 |
| 2018/0250842 | A1 * | 9/2018 | Slater | B26B 29/063 |

FOREIGN PATENT DOCUMENTS

| | | | |
|---|---|---|---|
| CN | 204414165 | U | 6/2015 |
| CN | 105798951 | A | 7/2016 |
| DE | 1013397 | B | 8/1957 |
| FR | 2206694 | A5 | 6/1974 |
| GB | 191402154 | A | 7/1914 |
| GB | 642219 | | 8/1950 |
| GB | 2541448 | * | 2/2017 |
| GB | 2541551 | * | 2/2017 |

OTHER PUBLICATIONS

Great Britain Patent Application No. GB1614024.6, Combined Search and Examination Report dated Oct. 7, 2016.

Great Britain Patent Application No. GB1514853.9, Search Report dated Dec. 1, 2015.

* cited by examiner

CUTTING APPARATUS

RELATED APPLICATIONS

This application is a national phase entry of International Patent Application No. PCT/GB/2016/052596, filed Aug. 22, 2016, which claims the benefit under 35 U.S.C. § 119(b) to Great Britain Patent Application No. 1514853.9, filed Aug. 20, 2015, the entire contents of which are hereby incorporated by reference.

This invention relates to a cutting apparatus. In particular but not exclusively, it relates to a bread knife.

When cutting bread using an ordinary bread knife it is difficult to evenly cut thin slices and the bread, particularly fresh bread, tends to squash or distort. A bow knife is advantageous as the blade is very thin and is supported by the bow of the knife. The thin blade reduces squashing of the loaf and helps to apply force to the bread to cut rather than squash or misshape the bread. However the slices are still often cut non-uniformly and inaccurately. This makes it very difficult to cut evenly or to cut very thin slices. The present invention arose in an attempt to design an improved knife.

According to the present invention, there is provided a cutting apparatus for cutting an item supported by a surface, comprising a knife comprising a blade, a blade support means, and an alignment guide, having an arm pivotally attached to the knife and a surface contacting means extending in a direction substantially perpendicular to the longitudinal plane of the knife and adapted to contact the surface in front of the blade, in the cutting direction so that, in use, the alignment guide can move with the blade, as the blade cuts into an item, whereby, if the knife tilts or tends to tilt, this is resisted by virtue of the alignment guide and, if the resistance is overcome, causes raising of one or other lateral edges of the surface containing means.

The present invention describes using an additional piece of apparatus that pivotally attaches to a bow knife such as a bow knife and is supported on a surface. This piece of apparatus can comprise a roller, slider or other means which moves along the surface in a longitudinal direction as the bread is cut in the same direction. This reduces tilting of the blade and enables uniform and easy cutting of the bread whilst also giving the option to cut very thin slices.

If the blade starts to tilt, or the user exerts a sideways or tilting force, then one edge of the roller or other surface containing means will have a greater pressure exerted on it by virtue of its reaction with the surface than the other edge. The user will feel this through the handle or support of the knife, usually even before one side has began to physically lift off the surface, and be able to correct it. If the tilt does occur, then one edge of the roller will raise, providing an additional visual aid to the user, to correct the cutting angle.

Preferably, the surface contacting means is pivotally attached to the arm so that, in use, the surface contacting means is free to rotate about a rotation axis, whereby it pivots as the knife descends into a loaf of bread for example. This can enable the surface contacting means to move relative to a surface, providing increased support and less strain on the movement when using the knife to cut an item.

Preferably, the surface contacting means is adapted to roll or slide along the surface when the knife is moved longitudinally to the surface.

Preferably, the knife is a bow knife, i.e. one in which a blade is supported at or towards each of its ends by a bowed support/handle.

Preferably, the arm pivots relative to the knife and the surface contacting means pivots relative to the arm.

The surface contacting means moves along the surface when the knife is used to cut an item on a surface such that tilting of the knife causes tilting of the surface contacting means, to thereby profile feedback to the user.

The arm of the alignment guide may be connected to a distal end of the knife.

The arm may be pivotally mounted via a hole on the knife, defined by a hole axis Preferably, the arm extends at an angle other than zero relative to the longitudinal direction of the blade to help balance weight across the knife.

The arm may be mounted within the hole using a clip.

Preferably, the arm is free to rotate about the hole axis.

The surface contacting means may have a cylindrical type shape having a first end, a second end and a middle portion. The diameters at the first and second end of the surface contacting means may be greater than the diameter at the middle portion to help stabilise the surface contacting means along the surface.

Preferably, the rotation axis and the hole axis are substantially parallel.

Preferably, the surface contacting means is a roller, adapted to rotate around a rotation axis, substantially perpendicular to the longitudinal axis of the blade.

Preferably, the blade has a longitudinal axis and the centre of the surface contacting means lies along the longitudinal axis.

The thickness of the blade is preferably below 1 mm.

Preferably, the arm is pivotally attached to a side of the bow knife that comprises the blade.

Preferably, the arm enters the hole from the side of the bow knife in which the blade is located.

In an embodiment a knife as claimed in any preceding claim wherein the surface contacting means comprises a shaft extending in a direction and generally parallel to the longitudinal direction of the knife, and having a wheel at or towards each end.

According to the present invention, there is further provided a cutting apparatus for cutting an item supported by a surface, comprising a knife comprising a blade, a blade support means, and an alignment guide pivotally attached to the knife and adapted to contact the surface so that, in use, the alignment guide can move with the blade, as the blade cuts into an item, to provide support when the knife is used to cut in a longitudinal direction and reduce tilting of the knife.

Embodiments of the present invention will now be described, by way of example only, with reference to the accompanying figures, in which.

Figures 6A, 6B, 6C:
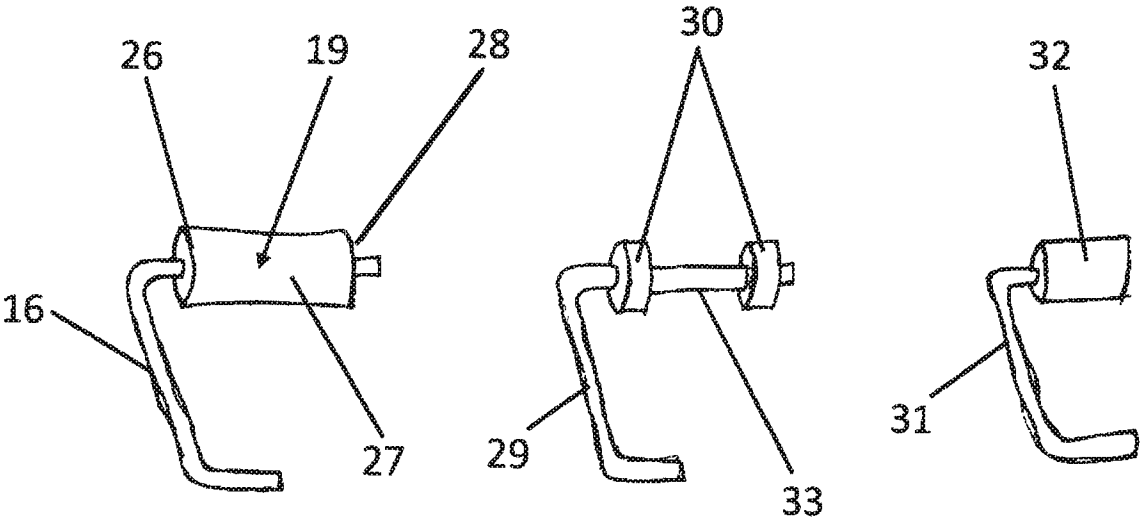
Figure 7A:
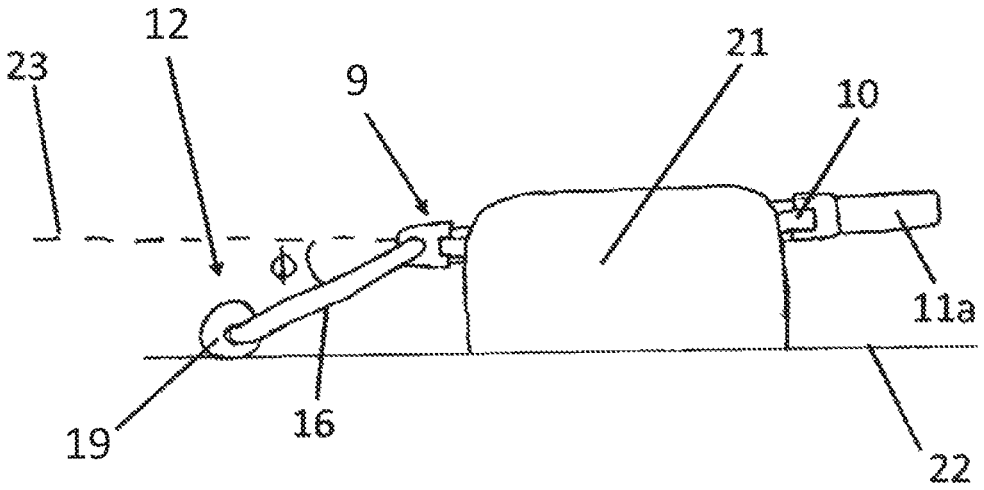
Figure 7B:
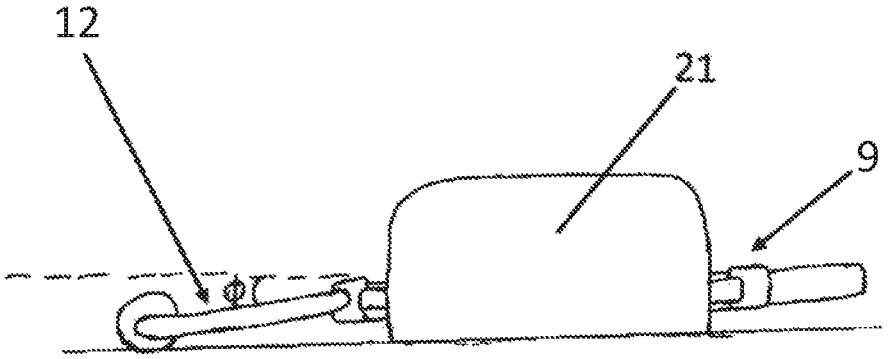
Figure 8:
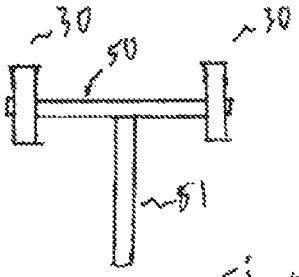

FIG. 6*a* illustrates an alignment guide;

FIG. 6*b* illustrates a second embodiment of alignment guide;

FIG. 6*c* illustrates a third embodiment of alignment guide;

FIG. 7*a* illustrates an angle an arm makes with the longitudinal axis of the knife;

FIG. 7*b* further illustrates another angle the arm makes with the longitudinal axis of the knife, as cutting progresses, and;

FIG. 8 illustrates a further embodiment.

Figure 1:
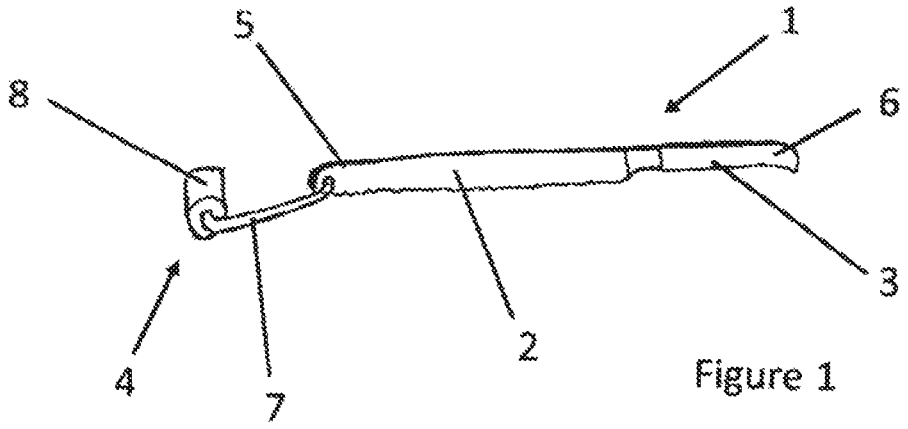
FIG. 1 shows a bread knife.

Referring to FIG. 1 a knife in accordance with the present invention is shown, indicated generally as 1. The knife 1 has a blade 2, blade support means (handle) 3 and an alignment guide 4. The knife 1 has a distal end 5 and a proximal end 6. The alignment guide 4, in this particular embodiment, is pivotally attached to the distal end 5 of the knife 1. The alignment guide 4 is not limited to this configuration and may be attached to any part of the knife 1. The alignment guide 4 consists of an arm 7 and a surface contacting means 8. The arm is pivotally attached to the knife to freely pivot relative thereto and extends generally therefrom in use.

Figure 2:
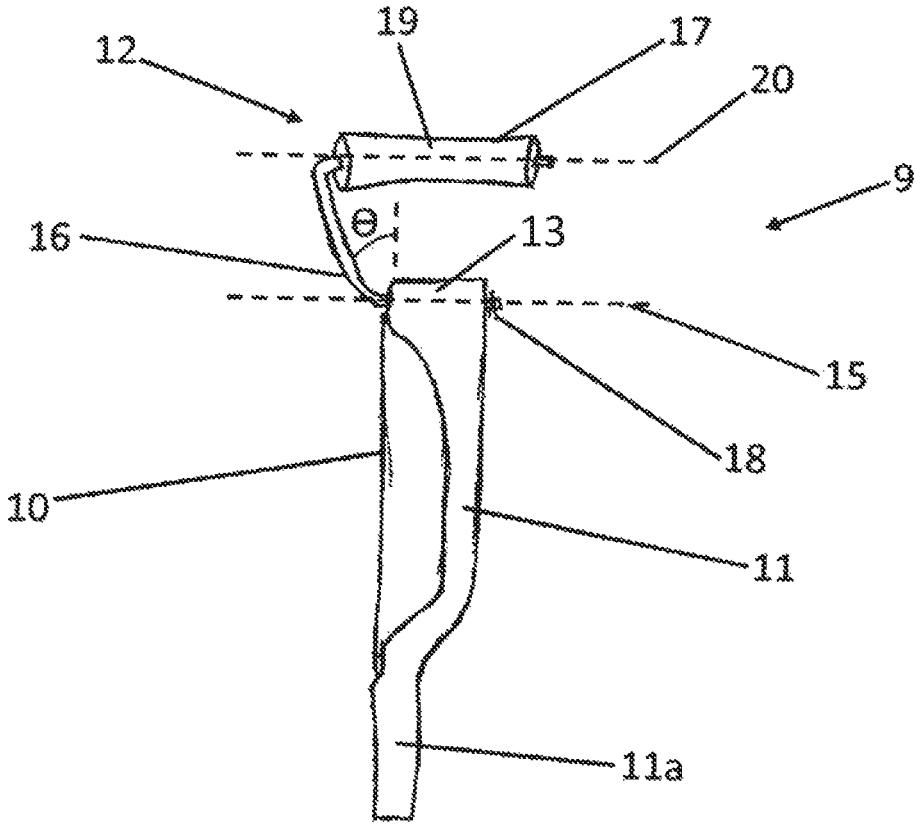
FIG. 2 shows a second embodiment of the knife, as a bow-type bread knife, in accordance with the present invention.

FIG. 2 shows a specific type of knife, a bow knife 9, in accordance with the present invention. The bow knife 9 has a blade 10, a blade support means 11, a handle 11*a* and an alignment guide 12 pivotally attached to a distal end 13 of the bow knife 9. The blade support means 11 has a hole 14 extending through a portion of the blade support means 11 which is defined by a hole axis 15. The alignment guide 12 consists of an arm 16 and a surface contacting means 17. The arm 16 is pivotally attached to the blade support means 11 by being inserted into the hole 14 from the side of the blade support means 11 in which the blade 10 is located. The arm extends at an angle θ from the distal end. The clip 18 is placed on the arm 16 at the other end of the blade support means 11 to fix the arm 16 to the blade support means 11. The method of securing the alignment guide 12 to the bow knife 9 (or knife 1) is not limited to using a clip 18 and other fixing apparatus may be used, such as a nut and bolt mechanism, which can allow free pivotal motion. The arm 16 can rotate freely about the hole axis 15. The arm 16 extends laterally outwardly at an angle to the distal end 13 of the bow knife 9 to help balance the entire bow knife 9 as the arm 16 and blade support means 11 are the heaviest elements of the bow knife 9. This will improve the weight distribution across the bow knife 9.

The surface contacting means 17, in this particular embodiment, is a roller 19 which is rotatably attached to the arm 16 so that it may rotate freely about a rotation axis 20 which lies with its axis of rotation perpendicular to the longitudinal axis of the blade 10. The rotation axis 20 and hole axis 15 thus may be generally parallel to each other, but are both perpendicular to the blade 10.

Figure 3:
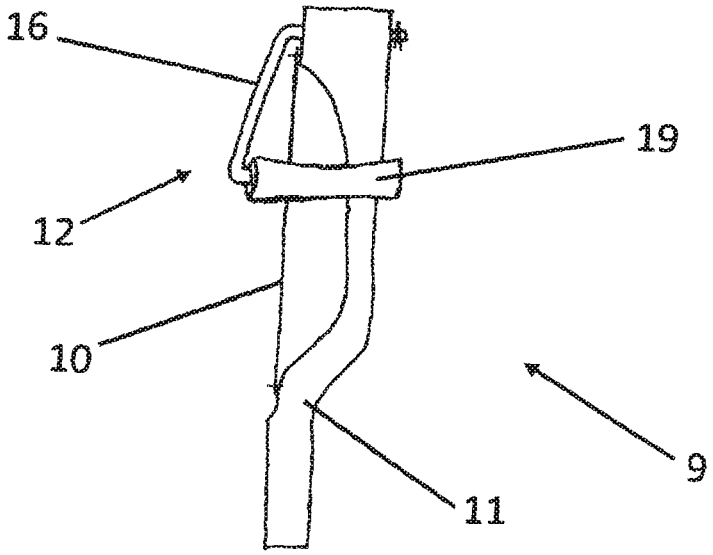
FIG. 3 illustrates another view of the bow knife in FIG. 2.

As seen in FIG. 3, the alignment guide 12 can be pivoted to be placed in a position on top of the blade 10 and blade support means 11 for easy storage as it takes a reduced amount of space. It may also be easily removed entirely therefrom, so that the knife can be used conventionally without it.

Figure 4:
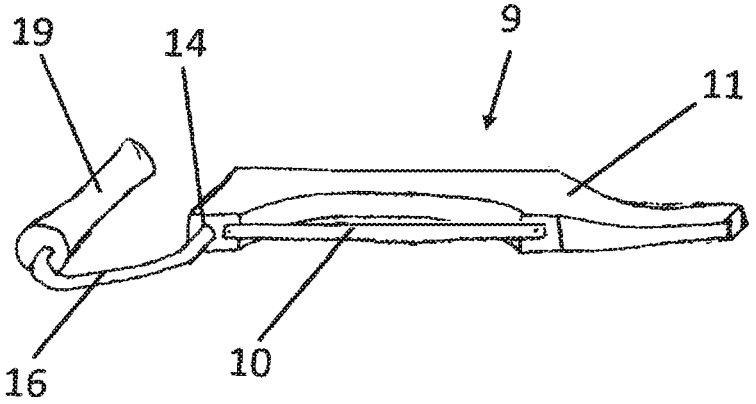
FIG. 4 illustrates a perspective view of the bow knife in FIG. 2.

Referring to FIG. 4, a perspective view of the bow knife 9 is shown.

Figure 5:
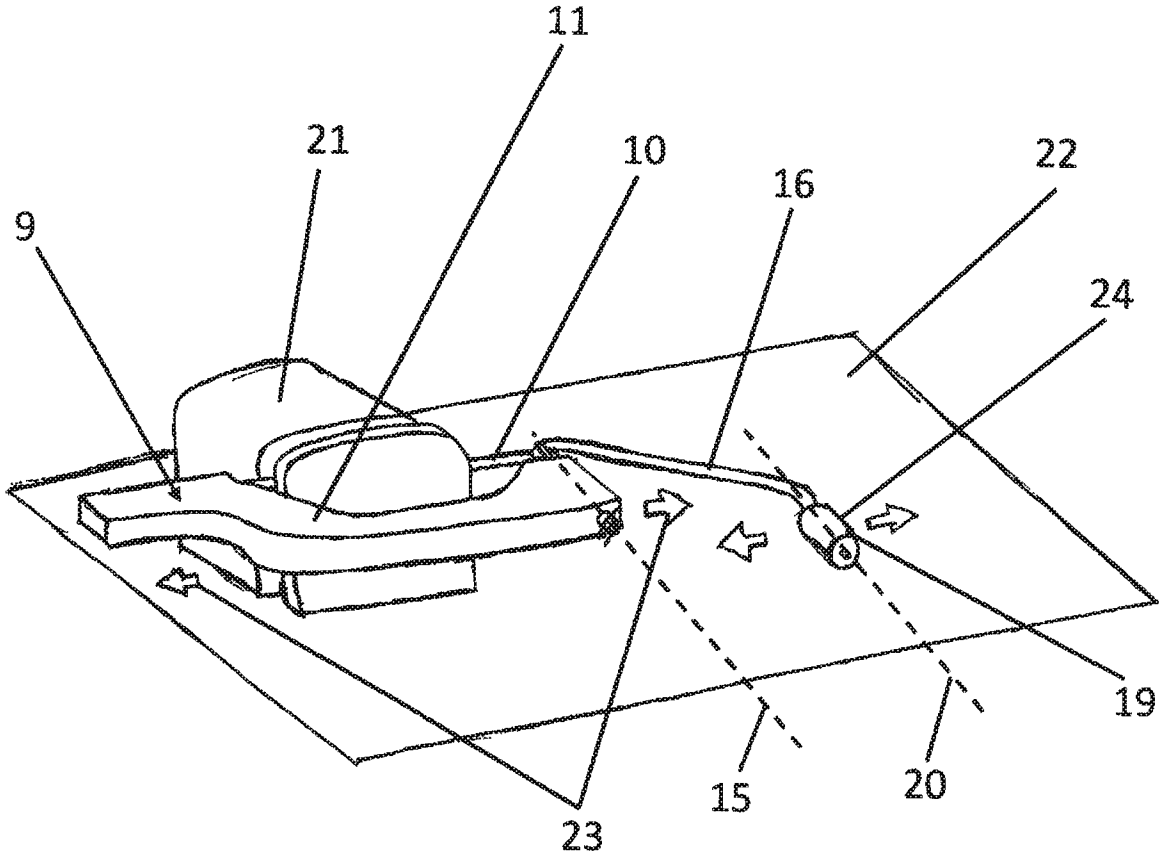
FIG. 5 illustrates the bow knife of FIG. 2 cutting bread.

FIG. 5 shows the bow knife 9 being used to cut bread 21. The bread 21 is placed on a surface 22 and the roller (surface contacting means) 19 of the alignment guide 12 is placed on the surface 22. The bow knife 9 is then moved along a longitudinal direction 23, whilst the roller 19 also moves along the longitudinal direction 23 with a side surface 24 of the roller 19 placed flat on the surface 22 as it rolls on the surface 22. The hole axis 15 and rotation axis 20 are perpendicular to the blade 10 and longitudinal direction 23. This reduces the tilting movement of the blade 10 when the bow knife 9 is used to cut the bread 21.

FIG. 6*a* illustrates one embodiment of the alignment guide 12 consisting of the arm 16 and surface contacting means 17. The surface contacting means 17, as shown in FIGS. 2 to 5, is a roller 19 which rotates freely about a rotation axis 20. The roller 19 shown in FIG. 6*a* also rotates freely about a rotation axis 20 but also has a first end 26, a middle portion 27 and a second end 28. The diameters at the first 26 and second end 28 are greater than the diameter of the middle portion 27. This helps stabilise the movement of the roller 19 along the surface 22 when the bow knife 9 is cutting an object placed on the surface 22.

FIG. 6*b* illustrates a second embodiment of the alignment guide 12 which comprises an arm 29 and surface contacting means 17. The surface contacting means comprises of two spaced apart rollers 30 on a central support 33 that are free to rotate about a rotation axis 20. More than two rollers may be located on the support 33. Support 33 may rotate with the rollers or may be a fixed axle upon which the rollers are mounted by bearings, for example, so that they can freely rotate relative to it.

FIG. 6*c* illustrates a third embodiment of the alignment guide 12 comprising an arm 31 and a surface contacting means 17. The surface contacting means 17 in this embodiment is a slider 32. This slider 32 is fixed to the arm 31 and cannot rotate relative to the arm 31. The slider 32 is placed on the surface 22 when the bow knife 9 is used to cut an item placed on the surface 22. The slider 32 can then slide along the surface 22 to provide support to the entire bow knife 9. The slider will of course be formed of, or at least have a face of, a low friction material which can slide on a work surface or chopping board, such as a plastic material, for example Nylon™ or Teflon™. The slide can be of any shape.

FIGS. 7*a* and 7*b* illustrate the angle ϕ made between the arm and the longitudinal direction. As the knife descends, when cutting an item (e.g. cutting bread as shown in the figure), the arm and roller or slider pivot so that the angle the arm makes with the longitudinal axis of the knife decreases as the roller or slider continues to move along the surface.

FIG. 8 shows an embodiment in which two rollers 30 are provided on an arm 50, which is part of a T shaped construction with shaft 51. A T shaped constructed may also be used where there is only one roller.

Of course, the item to be cut may be placed on a plate or board (e.g. bread board) on which is itself on a worktop or, table or other surface. The roller or other surface contacting means may extend beyond the edge of the board and roll on the worktop, table etc. This is still a support for the item, albeit via a secondary support (breadboard).

The above embodiment of the present invention have been described by way of example only and it will be apparent to those skilled in the art that modifications may be made without departing from the scope of the appended claims.

The invention claimed is:

1. A cutting apparatus for cutting an item supported by a surface, comprising an alignment guide, and a bow knife having a blade and a blade support means, the alignment guide having an arm pivotally attached to the bow knife and a surface contacting means extending in a direction substantially perpendicular to a longitudinal axis of the blade and adapted to rotate so that the surface contacting means contacts the surface in front of a distal end of the bow knife, in a cutting direction thereof so that, in use as the blade cuts into the item, the surface contacting means contacts the surface in front of the distal end of the bow knife and moves along the surface forwardly and backwardly as the blade cuts into the item, the surface contacting means having parts, at each lateral edge thereof, which contact the surface, whereby, if the bow knife tilts or tends to tilt, this is resisted by virtue of the alignment guide and, if the resistance is overcome, causes raising of one or other of the lateral edges of the surface contacting means from the surface.

2. A cutting apparatus as claimed in claim 1, wherein the surface contacting means is rotatably attached to the arm so that, in use, the surface contacting means is free to rotate about a rotation axis.

3. A cutting apparatus as claimed in claim 2, wherein the arm pivots relative to the bow knife and the surface contacting means rotates about the rotation axis.

4. A cutting apparatus as claimed in claim 1, wherein the surface contacting means is adapted to roll or slide along the surface when the bow knife is moved longitudinally to the surface.

5. A cutting apparatus as claimed in claim 1, wherein the surface contacting means moves along the surface when the bow knife is used to cut the item on the surface such that tilting of the bow knife causes tilting of the surface contacting means, to thereby provide feedback to a user.

6. A cutting apparatus as claimed in claim 1, wherein the arm of the alignment guide is connected to a distal end of the bow knife.

7. A cutting apparatus as claimed in claim 1, wherein the arm extends at an angle other than zero relative to the longitudinal axis of the blade to help balance weight across the knife.

8. A cutting apparatus as claimed in claim 1, wherein the surface contacting means has a generally circular cross-section having a first end, a second end and a middle portion.

9. A cutting apparatus as claimed in claim 8, wherein the diameters at the first and second ends of the surface contacting means are greater than the diameter at the middle portion to help stabilise the surface contacting means along the surface.

10. A cutting apparatus as claimed in claim 1, wherein the surface contacting means is a roller, adapted to rotate around a rotation axis which is substantially perpendicular to the longitudinal axis of the blade.

11. A cutting apparatus as claimed in claim 1, wherein the centre of the surface contacting means lies along perpendicular to the longitudinal axis of the blade.

12. A cutting apparatus as claimed in claim 1, wherein the arm is pivotally attached to a side of the bow knife.

13. A cutting apparatus as claimed in claim 1 wherein the blade is configured for cutting bread.

14. A cutting apparatus as claimed in claim 1 wherein the surface contacting means comprises a shaft extending in a direction generally perpendicular to the cutting direction of the bow knife, and having a roller at or towards each end of the shaft.

15. A method of preventing or reducing tilt of a bow knife, comprising providing a knife cutting apparatus as claimed in claim 1, positioning the bow knife upon an item to be cut, which is supported by a surface, positioning the alignment guide so that the surface contacting means contacts the surface in front of the blade, and using mechanical and/or visual feedback from the alignment guide to prevent or reduce tilt.

* * * * *